US010943548B1

(12) United States Patent
Lin et al.

(10) Patent No.: US 10,943,548 B1
(45) Date of Patent: Mar. 9, 2021

(54) SCENE-BASED ADAPTIVE BACKLIGHT ADJUSTMENT METHOD AND CIRCUIT FOR LOCAL DIMMING

(71) Applicant: HIMAX TECHNOLOGIES LIMITED, Tainan (TW)

(72) Inventors: Bo-Ruei Lin, Tainan (TW); Ying-Han Yeh, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/559,549

(22) Filed: Sep. 3, 2019

(51) Int. Cl.
*G09G 3/34* (2006.01)
*G09G 3/32* (2016.01)

(52) U.S. Cl.
CPC ..... *G09G 3/342* (2013.01); *G09G 3/32* (2013.01); *G09G 2320/0233* (2013.01); *G09G 2320/0626* (2013.01); *G09G 2360/16* (2013.01)

(58) Field of Classification Search
CPC .. G09G 3/342; G09G 3/32; G09G 2320/0233; G09G 2320/0626; G09G 2360/16
See application file for complete search history.

(56) References Cited

U.S. PATENT DOCUMENTS

2006/0209005 A1 9/2006 Pedram
2012/0287172 A1* 11/2012 Lin ..... G09G 3/3426 345/690
2016/0260390 A1* 9/2016 Diao ..... G09G 3/3406
2019/0005630 A1* 1/2019 Li ..... G09G 3/3426
2019/0355316 A1* 11/2019 Ji ..... G09G 3/36

FOREIGN PATENT DOCUMENTS

TW 201027510 A1 7/2010
TW I344121 6/2011
TW I518661 B 1/2016

* cited by examiner

*Primary Examiner* — Christopher E Leiby
(74) *Attorney, Agent, or Firm* — Winston Hsu

(57) ABSTRACT

A image adjustment method applicable to a display includes: defining multiple areas on a display region of the display; obtaining statistics of grayscale of a preliminary image; determining an image type of the preliminary image according to the statistics of grayscale of the preliminary image; generating a Cumulative Distribution Function (CDF) of luminance according to the statistics of grayscale of the preliminary image; individually adjusting a backlight level for each of the areas according to the CDF and the image type of the preliminary image; and generating an output image with each of the areas being individually adjusted.

22 Claims, 6 Drawing Sheets

SCENE-BASED ADAPTIVE BACKLIGHT ADJUSTMENT METHOD AND CIRCUIT FOR LOCAL DIMMING

BACKGROUND OF THE INVENTION

1. Field of the Invention

The present invention relates to an image compensation technique, and more particularly, relating to a technique of dynamically adjusting the backlight level of each area of a light emitting diode (LED) display.

2. Description of the Prior Art

LED-backlit is a flat display technique using LED backlighting instead of cold cathode fluorescent (CCFL) backlighting. A LED-backlit display may offer reduced energy consumption, better contrast and brightness.

The capability of individually controlling backlight level of LEDs allows for the local dimming technology which makes the dark portions in an image to provide pure dark sensations.

Conventional local dimming methods suffer from disadvantages such as high power consumption and decreased luminance. In addition, conventional local dimming methods may introduce unwanted side effects that deteriorate the image quality. For example, the conventional local dimming methods may cause the halo effect or Mosaic effect, when makes the images seem blocky or pixelated.

In view of the above, there is a need for a novel method to solve the aforementioned problems.

SUMMARY OF THE INVENTION

An objective of the present invention is to provide a scene-based adaptive backlight adjustment method and circuit for local dimming. More specifically, the present invention provides a method and an associated apparatus for dynamically adjusting the backlight level of each area of LED display in order to solve the above problems.

According to an embodiment of the present invention, an image adjustment method applicable to a display is provided. The image adjustment method comprises: defining multiple areas on a display region of the display; obtaining statistics of grayscale of a preliminary image; determining an image type of the preliminary image according to the statistics of grayscale of the preliminary image; generating a Cumulative Distribution Function (CDF) of luminance according to the statistics of grayscale of the preliminary image; individually adjusting a backlight level for each of the areas according to the CDF and the image type of the preliminary image; and generating an output image with each of the areas being individually adjusted.

According to an embodiment of the present invention, an image adjustment circuit applicable to a display is provided. The image adjustment circuit comprises a storage unit; and a processor. The process is arranged to perform following steps: defining multiple areas on a display region of the display; obtaining statistics of grayscale of a preliminary image; determining an image type of the preliminary image according to the statistics of grayscale of the preliminary image; generating a CDF of luminance according to the statistics of grayscale of the preliminary image; individually adjusting a backlight level for each of the areas according to the CDF and the image type of the preliminary image; and generating an output image with each of the areas being individually adjusted.

These and other objectives of the present invention will no doubt become obvious to those of ordinary skill in the art after reading the following detailed description of the preferred embodiment that is illustrated in the various figures and drawings.

DETAILED DESCRIPTION

Some phrases in the present specification and claims refer to specific elements; however, please note that the manufacturer might use different terms to refer to the same elements. Further, in the present specification and claims, the term "comprising" is open type and should not be viewed as the term "consists of." The term "electrically coupled" can refer to either direct connection or indirect connection between elements. Thus, if the specification describes that a first device is electrically coupled to a second device, the first device can be directly connected to the second device, or indirectly connected to the second device through other devices or means.

Figure 1A:
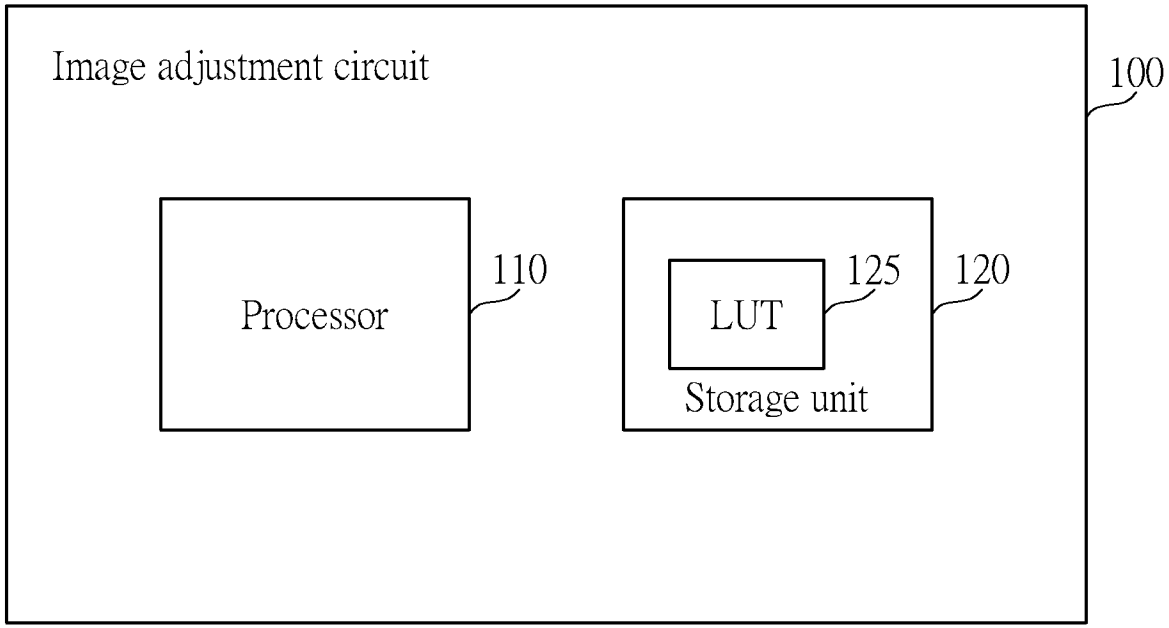
FIG. 1A is a diagram illustrating an image adjustment circuit according to an embodiment of the present invention.
Figure 1B:
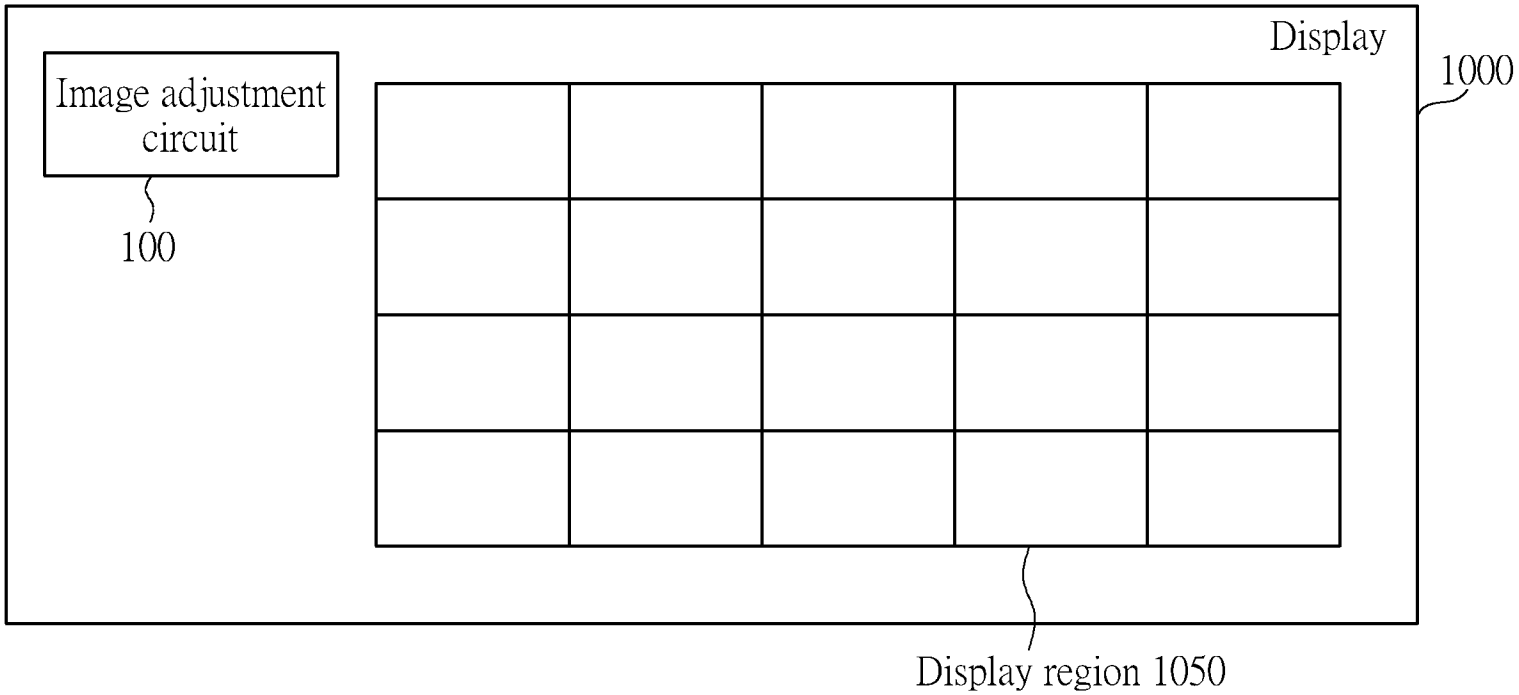
FIG. 1B shows an example of a display that includes the image adjustment circuit shown in FIG. 1A.

Please refer to FIG. 1A, which is a diagram illustrating an image adjustment circuit 100 according to an embodiment of the present invention, wherein the image adjustment circuit 100 is applicable to a display, such as an LED monitor. As shown in FIG. 1A, the image adjustment circuit 100 comprises a processor 110 and a storage unit 120. The processor 110 may be used to run program codes and perform various kinds of operations, especially the steps shown in FIG. 2. The storage unit 120 may be used to store a look-up table (LUT) 125. FIG. 1B shows an example of the aforementioned display, wherein the display 1000 comprises a display region 1050 that can be divided into multiple areas as those shown in the grid pattern in FIG. 1B, and the light emitted from each area is attributed to multiple LEDs inside.

Figure 2:
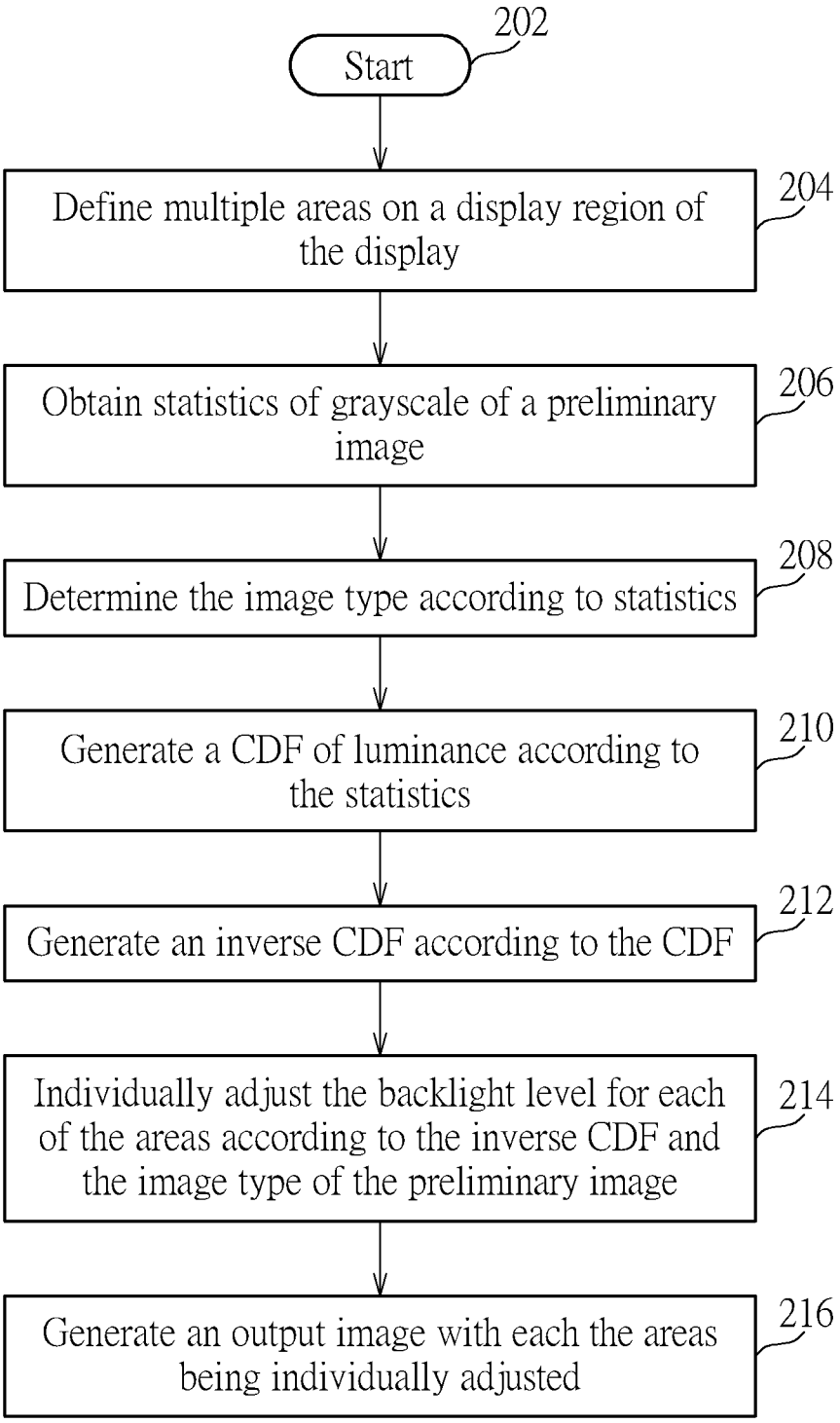
FIG. 2 is a flowchart illustrating an image adjustment method corresponding to the image adjustment circuit shown in FIG. 1A.

FIG. 2 is a flowchart illustrating an image adjustment method 200 corresponding to the image adjustment circuit 100 shown in FIG. 1A. If the result is substantially the same, the steps may not necessarily be executed in the exact order shown in FIG. 2. The image adjustment method 200 is summarized as follows.

Step 202: Start;

Step 204: Define multiple areas on a display region of the display;

Step 206: Obtain statistics of grayscale of a preliminary image;

Step 208: Determine the image type of the preliminary image according to the statistics of grayscale of the preliminary image;

Step 210: Generate a Cumulative Distribution Function (CDF) of luminance according to the statistics of grayscale of the preliminary image;

Step 212: Generate an inverse CDF according to the CDF;

Step 214: Individually adjust the backlight level for each of the areas according to the inverse CDF of luminance and the image type of the preliminary image;

Step 216: Generate an output image with each of the areas being individually adjusted.

Figure 3A:
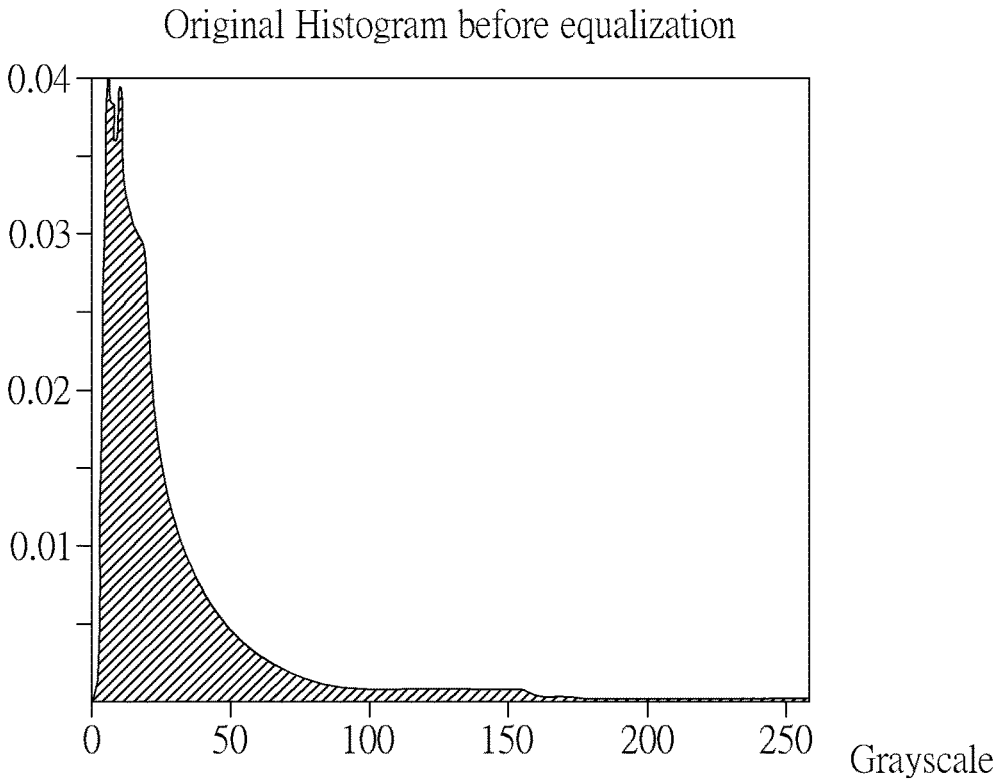
FIG. 3A is a diagram illustrating a histogram relating to grayscale.
Figure 3B:
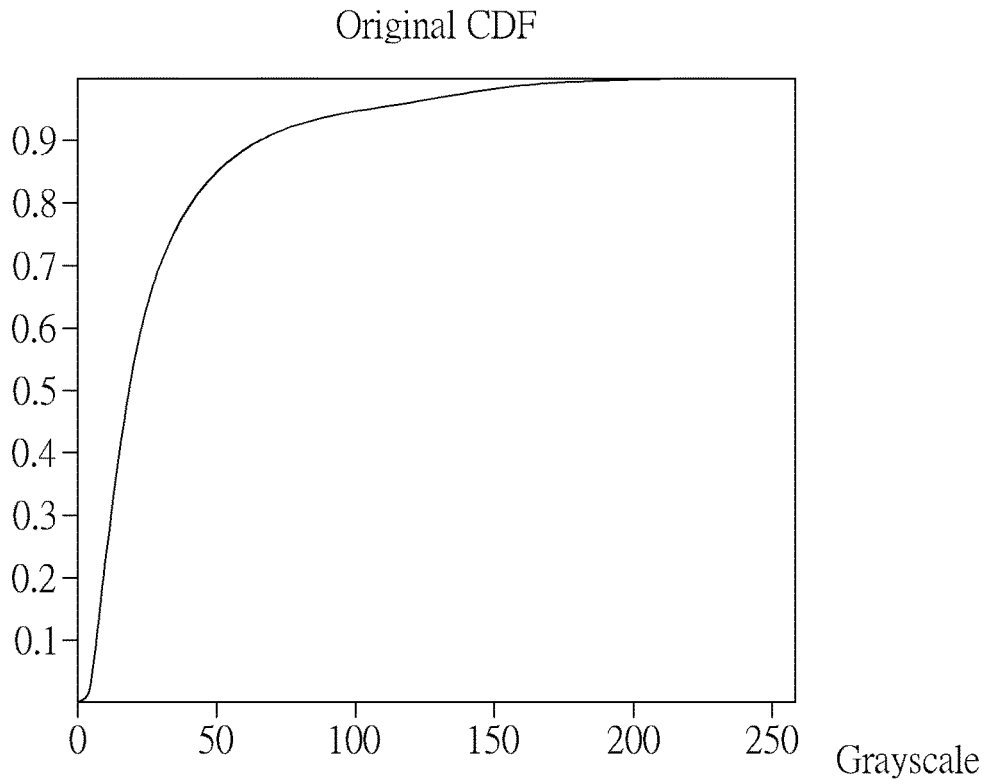
FIG. 3B is a diagram illustrating a CDF converted from the histogram shown in FIG. 3A.
Figure 4A:
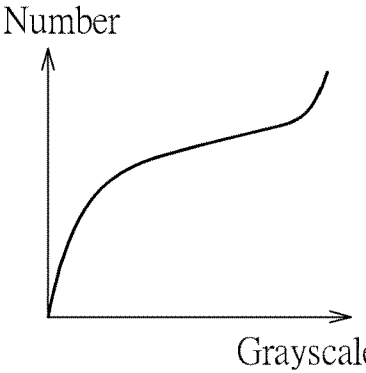
FIGS. 4A-4D show various examples of the CDF of luminance, each having a difference distribution.
Figure 4B:
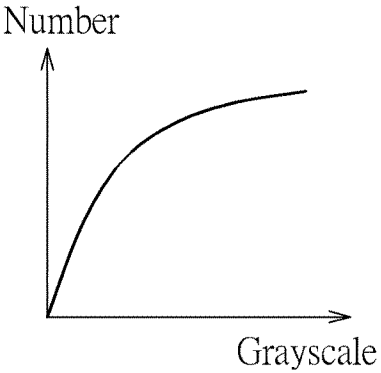
Figure 4C:
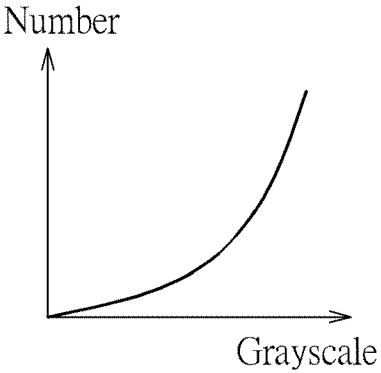
Figure 4D:
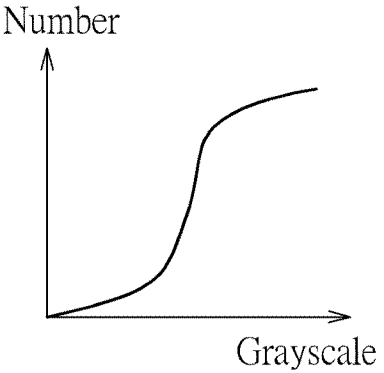
Figure 5A:
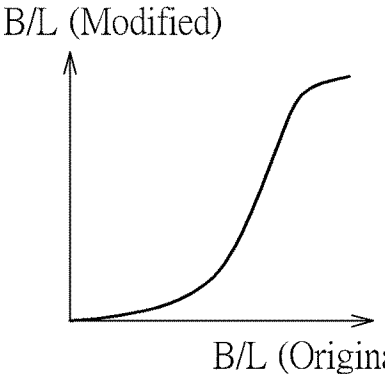
FIGS. 5A-5D show the inverse CDFs converted from the CDFs in FIGS. 4A-4D, respectively.
Figure 5B:
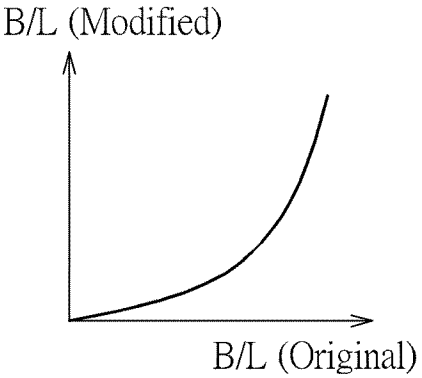
Figure 5C:
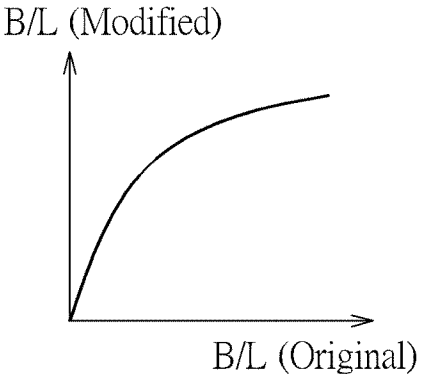
Figure 5D:
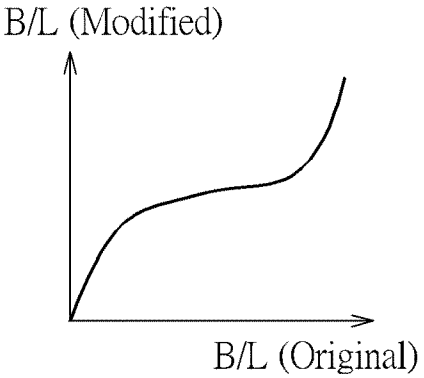

In step 206, statistics of grayscale can be referred to FIG. 3A, which is a diagram illustrating an original histogram before the equalization, wherein the horizontal axis represents the grayscale. The histogram shown in FIG. 3A can be converted into the CDF shown in FIG. 3B by the processor 110, as described in step 210. The CDF of luminance is statistics for providing the information about how many pixels in each grayscale, and the CDF of luminance can be used to determine the image type of the preliminary image, wherein the preliminary image can be realized as an unprocessed image or data. Image types may be roughly classified as either dark-dominant or light-dominant images. Most pixels of a dark-dominant image have low grayscale (e.g. closer or equal to 0), while most pixels of a light-dominant image have high grayscale (e.g. closer or equal to 255). In other words, a dark-dominant image is an image that comprises a majority of low grayscale pixels and dark-dominant areas are areas that comprise a majority of low grayscale pixels. Similarly, a light-dominant image is an image that comprises a majority of high grayscale pixels, and light-dominant areas are areas that comprise a majority of high grayscale pixels.

To be more specific, image types may be classified as dark scene images, text images and webpage images. In general, a dark scene image, such as a cinema image, requires dark pixels to look even darker, so that some detailed curves and edges can be revealed more clearly. Hence, reducing the backlight levels of those dark-dominant areas may improve the overall image quality.

However, regarding a light-dominant image, such as a text image or webpage image, dark pixels only occupy a small part of the entire display region 1050. In this situation, reducing the backlight levels of those unnoticeable dark-dominant areas simply makes them more noticeable without providing an advantage. For example, the entire image may seem even more blocky or pixelated, which deteriorates the image quality and greatly lowers the user experience.

To address the above problem encountered in related art techniques, the present invention further takes the image type of the preliminary image (i.e. the image not outputted yet) into account in order to make the light-dominant image look smooth and natural. FIG. 3A is an original histogram of a dark-dominant image according to an embodiment of the present invention. As can be seen from the histogram, the number of low grayscale pixels (e.g. approximately ranging from 0 to 50) is much more than the number of high grayscale pixels. Hence, in Step 208, the image type of the preliminary image is determined according to the histogram shown in FIG. 3A. Further, in Step 210, the CDF of luminance (e.g. the CDF shown in FIG. 3B) can be generated according to the histogram shown in FIG. 3A, and the CDF of luminance can later be used to generate the inverse CDF in Step 212. FIGS. 4A-4D show various examples of the CDF of luminance, each having a difference distribution. FIGS. 5A-5D show the inverse CDFs respectively converted from the CDFs in FIGS. 4A-4D, wherein the term "backlight" is briefed as "B/L" in FIGS. 5A-5D. The inverse CDF can be stored into the LUT 125 of the storage unit 120 of the image adjustment circuit 100, for follow-up use. The inverse CDFs shown in in FIGS. 5A-5D may be used to perform local dimming, that is, to adjust the backlight in an area-by-area manner.

In Step 214, the backlight level of each of the areas is individually adjusted according to the inverse CDF of luminance and the image type of the preliminary image. As explained above, referencing the image type of the preliminary image is crucial for reducing the blocky or pixelated effect resulted from the local-dimming operations, and the detailed utilizations of the image type of the preliminary are as follows.

When the image type is determined as a dark-dominant image rather than a light-dominant image, the backlight level of all of the areas will be reduced by a first extent, wherein the dark-dominant image is an image that comprises a majority of low grayscale pixels, and the dark-dominant areas are areas that comprise a majority of low grayscale pixels.

On the other hand, when the image type is determined as a light-dominant image rather than the dark-dominant image, the backlight level of any of dark-dominant areas amongst the areas will be reduced by a second extent smaller than the first extent, wherein the light-dominant image is an image that comprises a majority of high grayscale pixels, thereby alleviating the aforementioned blocky or pixelated effect. In another example, the backlight level of any of dark-dominant areas amongst the areas can be even raised or remained unchanged based on different user modes or settings, in order to further suppress the aforementioned blocky or pixelated effect.

After the compensation made to preliminary is done, Step 216 outputs an output image with each of the areas being individually adjusted.

Figure 6:
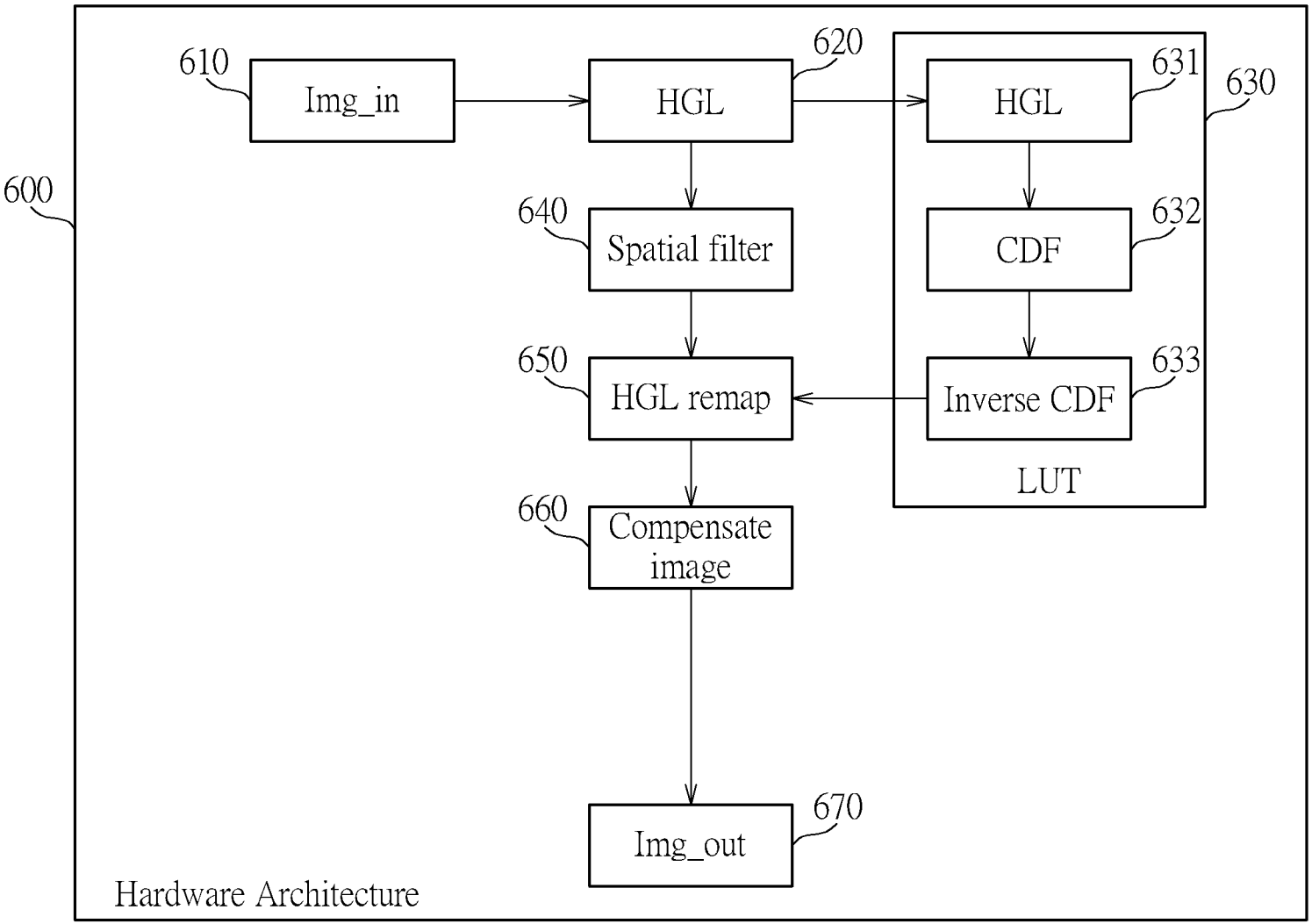
FIG. 6 shows a hardware architecture according to an embodiment of the present invention.

FIG. 6 shows a hardware architecture 600 according to an embodiment of the present invention, wherein the hardware architecture 600 may be adopted by the aforementioned image adjustment circuit 100, display 1000 and image adjustment method 200. Block 620 is marked with "HGL" which represents statistics, such as the histogram shown in FIG. 3A, retrieved from the preliminary image (marked with Img in) from Block 610. Block 630 represents an LUT unit which generates an inverse CDF of luminance in Block 633 from the CDF in Block 632 which is further based on the statistics in Block 631. Block 640 (marked with "Spatial filter") is used to perform some image processing, such as Fourier Transformation, etc. Block 650 is used for receiving the processing result from Block 640 and the inverse CDF from Block 630. Next, Block 660 utilizes the information from Block 650 to compensate the preliminary image so as to generate the compensated output image in Block 670.

In view of the above, embodiments of the present are capable of: reducing the halo effect for the dark scene image due to purified dark-dominant areas; and improving smooth in high bright scene or web scene images, e.g. mitigating the clipping effect due to steep grayscale difference between adjacent areas of the display.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. An image adjustment method applicable to a display, comprising:

defining multiple areas on a display region of the display;

obtaining statistics of grayscale of a preliminary image;

only performing a single determination according to the statistics of grayscale of the preliminary image to determine an image type of the preliminary image as a dark-dominant image or a light-dominant image;

generating a Cumulative Distribution Function (CDF) of luminance according to the statistics of grayscale of the preliminary image;

only performing a single adjustment of a backlight level for each of the areas by individually adjusting a backlight level for each of the areas according to the CDF and the image type of the preliminary image; and generating an output image with each of the areas being individually adjusted;

wherein the dark-dominant image is an image that comprises a majority of low grayscale pixels and the light-dominant image is an image that comprises a majority of high grayscale pixels.

2. The image adjustment method of claim 1, wherein the step of individually adjusting the backlight level of each of the areas according to the CDF and the image type further comprises:

generating an inverse CDF according to the CDF; and individually adjusting the backlight level of each of the areas according to the inverse CDF.

3. The image adjustment method of claim 2, wherein the inverse CDF is stored into a look-up table of the storage unit for follow-up use.

4. The image adjustment method of claim 1, wherein the display is a light emitting diode (LED) display.

5. The image adjustment method of claim 1, wherein when the image type is determined as a dark-dominant image, reducing the backlight level of all of the areas by a first extent.

6. The image adjustment method of claim 5, wherein the image type is a dark scene image.

7. The image adjustment method of claim 5, wherein when the image type is determined as a light-dominant image rather than the dark-dominant image, determining dark-dominant areas amongst the areas.

8. The image adjustment method of claim 7, further comprising:

reducing the backlight level of dark-dominant areas by a second extent smaller than the first extent.

9. The image adjustment method of claim 7, further comprising:

not changing the backlight level of any of dark-dominant areas amongst the areas.

10. The image adjustment method of claim 1, wherein when the image type is determined as a light-dominant image, raising the backlight level of all of the areas.

11. The image adjustment method of claim 1, wherein the image type is a webpage image.

12. An image adjustment circuit applicable to a display, comprising:

a storage unit; and a processor, arranged to perform the following steps:

defining multiple areas on a display region of the display;

obtaining statistics of grayscale of a preliminary image;

only performing a single determination according to the statistics of grayscale of the preliminary image to determine an image type of the preliminary image as a dark-dominant image or a light-dominant image;

generating a Cumulative Distribution Function (CDF) of luminance according to the statistics of grayscale of the preliminary image;

only performing a single adjustment of a backlight level for each of the areas by individually adjusting a backlight level for each of the areas according to the CDF and the image type of the preliminary image; and generating an output image with each of the areas being individually adjusted;

wherein the dark-dominant image is an image that comprises a majority of low grayscale pixels and the light-dominant image is an image that comprises a majority of high grayscale pixels.

13. The image adjustment circuit of claim 12, wherein the step of individually adjusting the backlight level of each of the areas according to the CDF and the image type further comprises:

generating an inverse CDF according to the CDF; and individually adjusting the backlight level of each of the areas according to the inverse CDF.

14. The image adjustment circuit of claim 13, wherein the inverse CDF is stored into a look-up table (LUT) of the storage unit for follow-up use.

15. The image adjustment circuit of claim 12, wherein the display is a light emitting diode (LED) display.

16. The image adjustment circuit of claim 12, wherein when the image type is determined as a dark-dominant image, the processor reduces the backlight level of all of the areas by a first extent.

17. The image adjustment circuit of claim 16, wherein the image type is a dark scene image.

18. The image adjustment circuit of claim 16, wherein when the image type is determined as a light-dominant image rather than the dark-dominant image, the processor determines dark-dominant areas amongst the areas.

19. The image adjustment circuit of claim 18, wherein the processor further reduces the backlight level of dark-dominant areas by a second extent smaller than the first extent.

20. The image adjustment circuit of claim 18, wherein the processor does not change the backlight level of any of dark-dominant areas amongst the areas.

21. The image adjustment circuit of claim 12, wherein when the image type is determined as a light-dominant image, the processor raises the backlight level of all of the areas.

22. The image adjustment circuit of claim 12, wherein the image type is a webpage image.

* * * * *